US011441733B2

(12) United States Patent
Heinz et al.

(10) Patent No.: US 11,441,733 B2
(45) Date of Patent: Sep. 13, 2022

(54) TRANSPORT CONTAINER WITH COOLABLE THERMAL SHIELD

(71) Applicant: Linde GmbH, Pullach (DE)

(72) Inventors: Posselt Heinz, Bad Aibling (DE); Juergen Bichlmeier, Garching a.d.Alz (DE); Niels Treuchtlinger, Amerang (DE); Teodor Todorov, Altenmarkt (DE)

(73) Assignee: Linde GmbH, Pullach (DE)

( * ) Notice: Subject to any disclaimer, the term of this patent is extended or adjusted under 35 U.S.C. 154(b) by 156 days.

(21) Appl. No.: 16/770,276

(22) PCT Filed: Dec. 5, 2018

(86) PCT No.: PCT/EP2018/025308
§ 371 (c)(1),
(2) Date: Jun. 5, 2020

(87) PCT Pub. No.: WO2019/110146
PCT Pub. Date: Jun. 13, 2019

(65) Prior Publication Data

US 2020/0378557 A1 Dec. 3, 2020

(30) Foreign Application Priority Data

Dec. 8, 2017 (EP) ..... 17020563

(51) Int. Cl.
*F17C 1/12* (2006.01)
*F17C 13/00* (2006.01)

(52) U.S. Cl.
CPC ..... *F17C 1/12* (2013.01); *F17C 13/001* (2013.01); *F17C 2201/0109* (2013.01);
(Continued)

(58) Field of Classification Search
CPC .. F17C 1/12; F17C 13/001; F17C 2201/0109; F17C 2201/035; F17C 2203/0312;
(Continued)

(56) References Cited

U.S. PATENT DOCUMENTS 2,871,669 A 2/1959 Douglas et al.
3,782,128 A 1/1974 Hampton et al.
(Continued)

FOREIGN PATENT DOCUMENTS

WO 2017/190849 A1 11/2017

OTHER PUBLICATIONS

International Search Report of the International Searching Authority for PCT/EP2018/025308 dated Feb. 13, 2019.
(Continued)

*Primary Examiner* — Shawn M Braden
(74) *Attorney, Agent, or Firm* — Millen White Zelano & Branigan, PC; Brion P. Heaney

(57) ABSTRACT

The invention relates to a transport container (1) for helium (He), comprising an inner container (6) for receiving the helium (He); a coolant container (14) for receiving a cryogenic fluid (N2); an outer container (2) in which the inner container (6) and the coolant container (14) are received; a thermal shield (21) in which the inner container (6) is received and which can be actively cooled using the cryogenic fluid (N2), said thermal shield (21) having at least one cooling line (26) which is fluidically connected to the coolant container (14) and in which the cryogenic fluid (N2) can be received in order to actively cool the thermal shield (21); and at least one return line (34, 35), by means of which the at least one cooling line (26) is fluidically connected to the coolant container (14) in order to return the cryogenic fluid (N2) back to the coolant container (14).

20 Claims, 3 Drawing Sheets

(52) U.S. Cl.
CPC ..... *F17C 2201/035* (2013.01); *F17C 2203/0312* (2013.01); *F17C 2203/0366* (2013.01); *F17C 2203/0629* (2013.01); *F17C 2221/017* (2013.01); *F17C 2223/0115* (2013.01); *F17C 2223/0161* (2013.01); *F17C 2223/033* (2013.01); *F17C 2227/0341* (2013.01); *F17C 2227/0379* (2013.01); *F17C 2260/032* (2013.01)

(58) Field of Classification Search
CPC ..... F17C 2203/0366; F17C 2203/0629; F17C 2221/017; F17C 2223/0115; F17C 2223/0161; F17C 2223/033; F17C 2227/0341; F17C 2227/0379; F17C 2260/032
See application file for complete search history.

(56) References Cited

U.S. PATENT DOCUMENTS

| | | | | |
|---|---|---|---|---|
| 4,718,239 | A | 1/1988 | Nowobilski et al. | |
| 2019/0145578 | A1* | 5/2019 | Posselt | F17C 3/10 220/560.14 |
| 2019/0212049 | A1* | 7/2019 | Strobel | F25B 49/005 |

OTHER PUBLICATIONS

English translation of International Search Report of the International Searching Authority for PCT/EP2018/025308 dated Feb. 13, 2019.

* cited by examiner

TRANSPORT CONTAINER WITH COOLABLE THERMAL SHIELD

The invention relates to a transport container for helium.

Helium is extracted together with natural gas. For economic reasons, transporting large amounts of helium is practicable only in liquid or supercritical form, i.e., at a temperature of approximately 4.2 to 6 K and at a pressure of 1 to 6 bar. In order to transport the liquid or supercritical helium, transport containers are used which are thermally insulated in a complex process so as to avoid an excessively rapid increase in pressure of the helium. Such transport containers can be cooled, for example, with the aid of liquid nitrogen. In doing so, a thermal shield cooled with the aid of the liquid nitrogen is provided. The thermal shield shields an inner container of the transport container. The liquid or cryogenic helium is received in the inner container. The holding time for the liquid or cryogenic helium in such transport containers is 35 to 40 days, which means that, after this time, the pressure in the inner container has increased to the maximum value of 6 bar. The supply of liquid nitrogen is enough for approximately 35 days.

Against this background, the aim of the present invention is to provide an improved transport container.

Accordingly, a transport container for helium is proposed. The transport container comprises an inner container for receiving the helium, a coolant container for receiving a cryogenic fluid, an outer container in which the inner container and the coolant container are received, a thermal shield in which the inner container is received and which can be actively cooled with the aid of the cryogenic fluid, wherein the thermal shield has at least one cooling line, which is fluidically connected to the coolant container and in which the cryogenic fluid can be received in order to actively cool the thermal shield, and at least one return line, with the aid of which the at least one cooling line is fluidically connected to the coolant container in order to return the cryogenic fluid back to the coolant container.

Since the return line is provided, the cryogenic fluid used for cooling is returned from the cooling line back to the coolant container. With the aid of the return line, a liquid phase, in particular, of the cryogenic fluid, which is carried along out of the cooling line of the thermal shield due to bubble formation in the cooling line and into the return line, and a vapor phase of the cryogenic fluid can be returned again to the coolant container. Due to the entrainment of the liquid phase, it can be ensured that the cryogenic fluid is always filled or present in the cooling line up to a highest point thereof. Non-vaporized cryogenic fluid is recirculated to the coolant container in a circulation—in particular, in a natural circulation, i.e., in an automatic circulation. The gaseous phase, as well, is returned to the coolant container again in this circulation.

The use of a phase separator, which usually separates the gaseous phase of the cryogenic fluid from the liquid phase of the cryogenic fluid, can thereby be completely dispensed with. This reduces the costs of producing and maintaining the transport container. Such a phase separator comprises moving parts, and therefore has a limited service life. Likewise, the heat transferred by a phase separator to a cooling system comprising the cooling line is not insignificant. This heat transfer is eliminated by dispensing with the phase separator. As an attachment part provided on the outer side of the transport container, such a phase separator can, furthermore, become damaged during handling of the transport container. This risk also no longer exists, due to the elimination of the phase separator. The transport container is thus phase separator-free or phase separator-less.

The aforementioned natural circulation preferably works without, or at least with low, overpressure. The pressure in the coolant container can therefore be reduced from 1.3 bara to 1.1 bara. This reduction in pressure leads to a decrease in the boiling temperature of the cryogenic fluid—in the present case, for example, nitrogen—of 1.5 K. The transfer of heat to the helium thereby decreases by approximately 5%, so that the helium holding time increases by approximately three days in comparison with known transport containers.

The inner container can also be referred to as a helium container or as an inner tank. The transport container can also be referred to as a helium transport container. The helium can be referred to as liquid or cryogenic helium. The helium is, in particular, likewise a cryogenic fluid. The transport container is, in particular, designed to transport the helium in a cryogenic or liquid or in supercritical form. In thermodynamics, the critical point is a thermodynamic state of a substance which is characterized by an equalization of the densities of the liquid phase and the gas phase. The differences between the two states of matter cease to exist at this point. In a phase diagram, the critical point represents the upper end of the vapor pressure curve.

The helium is introduced into the inner container in liquid or cryogenic form. A liquid zone with liquid helium and a gas zone with gaseous helium then form in the inner container. After being introduced into the inner container, the helium thus has two phases having different states of matter, viz., liquid and gaseous. This means that a phase boundary between the liquid helium and the gaseous helium is present in the inner container. After a certain time, i.e., when the pressure in the inner container rises, the helium present in the inner container becomes single-phase. The phase boundary then no longer exists, and the helium is supercritical.

The cryogenic fluid or the cryogen is preferably liquid nitrogen. The cryogenic fluid can also be referred to as a coolant. The cryogenic fluid can, alternatively, also be, for example, liquid hydrogen or liquid oxygen. The thermal shield being actively coolable or actively cooled is to be understood as meaning that the cryogenic fluid at least partially flows through or around the thermal shield so as to cool it. In the process, the cryogenic fluid boils, and thus the gaseous phase and the liquid phase of the cryogenic fluid are present. The cryogenic fluid can therefore be received in the cooling line in both its gaseous and liquid phases. The cryogenic fluid can likewise be received in the return line or be conveyed back to the coolant container in its liquid and/or its gaseous phase. In the return line, the liquid phase of the cryogenic fluid can at least partially vaporize. Non-vaporized fractions of the liquid phase of the cryogenic fluid fall back into the coolant container. The liquid phase is conveyed, in particular, with the aid of the gaseous phase of the cryogenic fluid. A pump with movable components can be dispensed with. During the operation of the transport container or of the thermal shield, the liquid phase of the cryogenic fluid continues to flow out of the coolant container into the cooling line when the cryogenic fluid vaporizes, so that the cooling line is always filled with the liquid phase over the entire length thereof. The coolant container, the cooling line, and the return line thus form a cooling system. The cooling system is a closed system, in which circulation of the cryogenic fluid is possible.

In particular, the thermal shield is actively cooled only during the operation of the transport container, i.e., when the inner container is filled with helium. When the cryogenic fluid is consumed, the thermal shield can also be uncooled. As mentioned above, the cryogenic fluid can vaporize in the cooling line, but also in the return line, during active cooling of the thermal shield. The thermal shield thus has a temperature that approximately or exactly corresponds to the boiling point of the cryogenic fluid. The boiling point of the cryogenic fluid is preferably higher than the boiling point of the liquid helium. The thermal shield is, in particular, arranged inside the outer container. The coolant container is preferably arranged outside the thermal shield. The cooling line and the return line are preferably two separate components. This means that the cooling line does not correspond to the return line.

The outer side of the inner container preferably has a temperature that corresponds approximately or exactly to the temperature of the helium stored in the inner container. Depending upon whether the helium is in liquid or supercritical form, the temperature of the helium is 4.2 to 6 K. Preferably, a cover section of the thermal shield completely covers a base section thereof at the end face in each case. The base section of the thermal shield can have a circular or approximately circular cross-section. The outer container, the inner container, the coolant container, and the thermal shield can be designed to be rotationally symmetrical with respect to a common central axis or axis of symmetry. The inner container and the outer container are preferably made of stainless steel. The inner container preferably has a tubular base section, which is closed on both sides by curved cover sections. The inner container is fluid-tight. The outer container preferably likewise has a tubular base section, which is closed at the end face on both sides by cover sections. The base section of the inner container and/or the base section of the outer container can have a circular or approximately circular cross-section. The thermal shield is preferably made of a high-purity aluminum material. The thermal shield is preferably not fluid-tight. This means that the thermal shield can have apertures or boreholes.

According to one embodiment, the at least one cooling line is fluidically connected to a liquid zone of the coolant container, and the at least one return line is fluidically connected to a gas zone of the coolant container.

The gas zone is arranged, with respect to a direction of gravity, above the liquid zone. A phase boundary is arranged between the gas zone and the liquid zone. When the cryogenic fluid is introduced into the coolant container, it vaporizes at least partially, and the gas zone arranged above the liquid zone is formed. The cooling line thus opens into the liquid zone, and the return line opens into the gas zone.

According to another embodiment, the at least one return line opens into the coolant container above, with respect to a direction of gravity, the at least one cooling line.

The return line is, in particular, connected directly to the coolant container. The cooling line can be connected to the coolant container via a connecting line. Alternatively, the cooling line can also be connected directly to the coolant container. The cooling line can have two vertical sections extending in the direction of gravity, which are connected to one another with the aid of sections arranged obliquely with respect to a horizontal. The cooling line can, furthermore, have a distributor into which the aforementioned connecting line opens and which is connected to the coolant container with the aid of the connecting line. The distributor represents a lowest point of the cooling line. A vertical section and an oblique section of the cooling line then lead away from the distributor. The vertical and oblique sections of the cooling conduit combine again at a collector. The collector represents a highest point of the cooling line. The return line is connected to the collector.

According to another embodiment, a lowest point of the at least one cooling line is fluidically connected to the coolant container.

The lowest point of the cooling line can be the aforementioned distributor, which is fluidically connected to the coolant container with the aid of the connecting line. The lowest point can also be referred to as the distributor, or the distributor can be referred to as the lowest point of the cooling line.

According to another embodiment, a highest point of the at least one cooling line is fluidically connected to the coolant container with the aid of the at least one return line.

The highest point of the cooling line is the aforementioned collector. The return line connects the collector to the coolant container. The highest point can also be referred to as the collector, or the collector can also be referred to as the highest point of the cooling line.

According to another embodiment, an inside diameter of the at least one return line is larger than an inside diameter of the at least one cooling line.

This reliably prevents the cryogenic fluid from accumulating in the return line. Rather, gas bubbles forming in the cryogenic fluid can entrain into the return line the liquid phase of the cryogenic fluid from the cooling line. For example, the inside diameter of the return line can be 10%, 20%, 30%, or 40% larger than the inside diameter of the cooling line.

According to another embodiment, the inside diameter of the at least one cooling line is greater than 10 millimeters.

For example, the inside diameter of the cooling line can be 12, 13, 14 or more millimeters.

According to another embodiment, the at least one return line is inclined at an angle of inclination in the direction of the coolant container.

This means that the return line drops off in the direction of the coolant container. This ensures that the liquid phase of the cryogenic fluid flows back into the coolant container. The inclination angle is defined as an inclination angle of the return line relative to a horizontal or to the axis of symmetry of the transport container. Thereby, the horizontal is positioned to be parallel to the axis of symmetry.

According to another embodiment, the at least one return line is connected to the thermal shield and arranged between the thermal shield and the outer container.

The return line preferably runs along an upper, with respect to the direction of gravity, region of the thermal shield. The return line can be thermally and/or mechanically coupled to the thermal shield. For example, the return line can be glued to the thermal shield or be clamped thereto. The return line can also be arranged within the thermal shield instead of outside the thermal shield.

According to another embodiment, during operation of the transport container, the cryogenic fluid boils to actively cool the thermal shield in the at least one cooling line, so that gas bubbles, arising in the at least one cooling line, of a gaseous phase of the cryogenic fluid convey a liquid phase of the cryogenic fluid into the at least one return line, so as to return the gaseous phase of the cryogenic fluid and/or the liquid phase of the cryogenic fluid back to the coolant container.

The gas bubbles entrain the liquid phase of the cryogenic fluid from the cooling line into the return line. However, this does not result in continuous conveyance, but in discontinuous conveyance of the liquid phase of the cryogenic fluid.

The cooling line and the return line thus form a pump device in the form of a bubble pump or a mammoth pump, which is suitable for feeding the cryogenic fluid from the coolant container through the cooling line and from the cooling line via the return line back to the coolant container.

According to another embodiment, a first return line and a second return line are provided which run parallel to one another.

The return lines can also extend away from one another. The number of return lines is arbitrary. However, at least one return line is provided.

According to a further embodiment, the coolant container has a bleed valve for bleeding off a gaseous phase of the cryogenic fluid from the coolant container.

In this way, the pressure in the coolant container is regulated. The bled off gaseous phase of the cryogenic fluid can be supplied to an actively-coolable insulating element arranged between the thermal shield and the outer container. After the gaseous phase of the cryogenic fluid has passed through this insulating element, the gaseous phase is no longer cryogenic and can be discharged into the environment as a heated gaseous phase, without causing undesirable icing on the transport container to occur.

According to another embodiment, the inner container is completely surrounded by the thermal shield.

This means that the thermal shield completely envelops the inner container. In this, the thermal shield is preferably not fluid-tight.

According to a further embodiment, the thermal shield has a cover section which is separate from the coolant container and is arranged between the inner container and the coolant container.

The thermal shield preferably features the tubular base section, which is closed on both sides by the cover sections. One of the cover sections of the thermal shield is arranged between the inner container and the coolant container. The cover section of the thermal shield is, in particular, positioned in an intermediate space provided between the inner container and the coolant container.

According to a further embodiment, the coolant container is arranged outside the thermal shield.

The coolant container is preferably positioned next to the thermal shield in an axial direction of the transport container. An intermediate space is provided between the coolant container and the thermal shield. The coolant container is preferably not part of the thermal shield.

Further possible implementations of the transport container also include not explicitly mentioned combinations of features or embodiments described above or below with respect to the exemplary embodiments. A person skilled in the art will also add individual aspects as improvements or additions to the basic form of the transport container in each case.

Further advantageous embodiments of the transport container are the subject matter of the subclaims and of the exemplary embodiments of the transport container described below. In addition, the transport container is explained in more detail on the basis of preferred embodiments, with reference to the accompanying figures.

Figure 1:
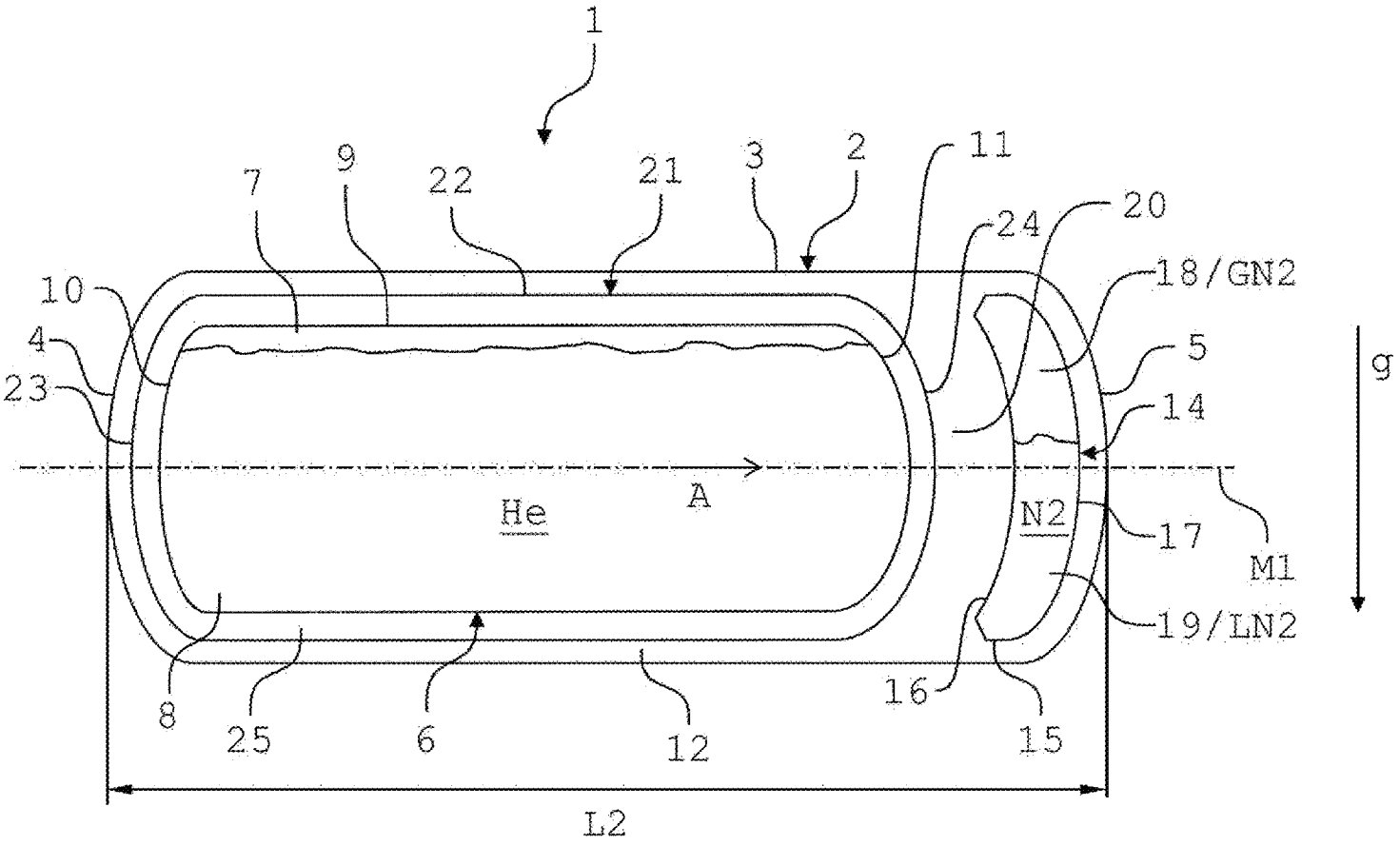
FIG. 1 shows a schematic view of an embodiment of a transport container.
Figure 2:
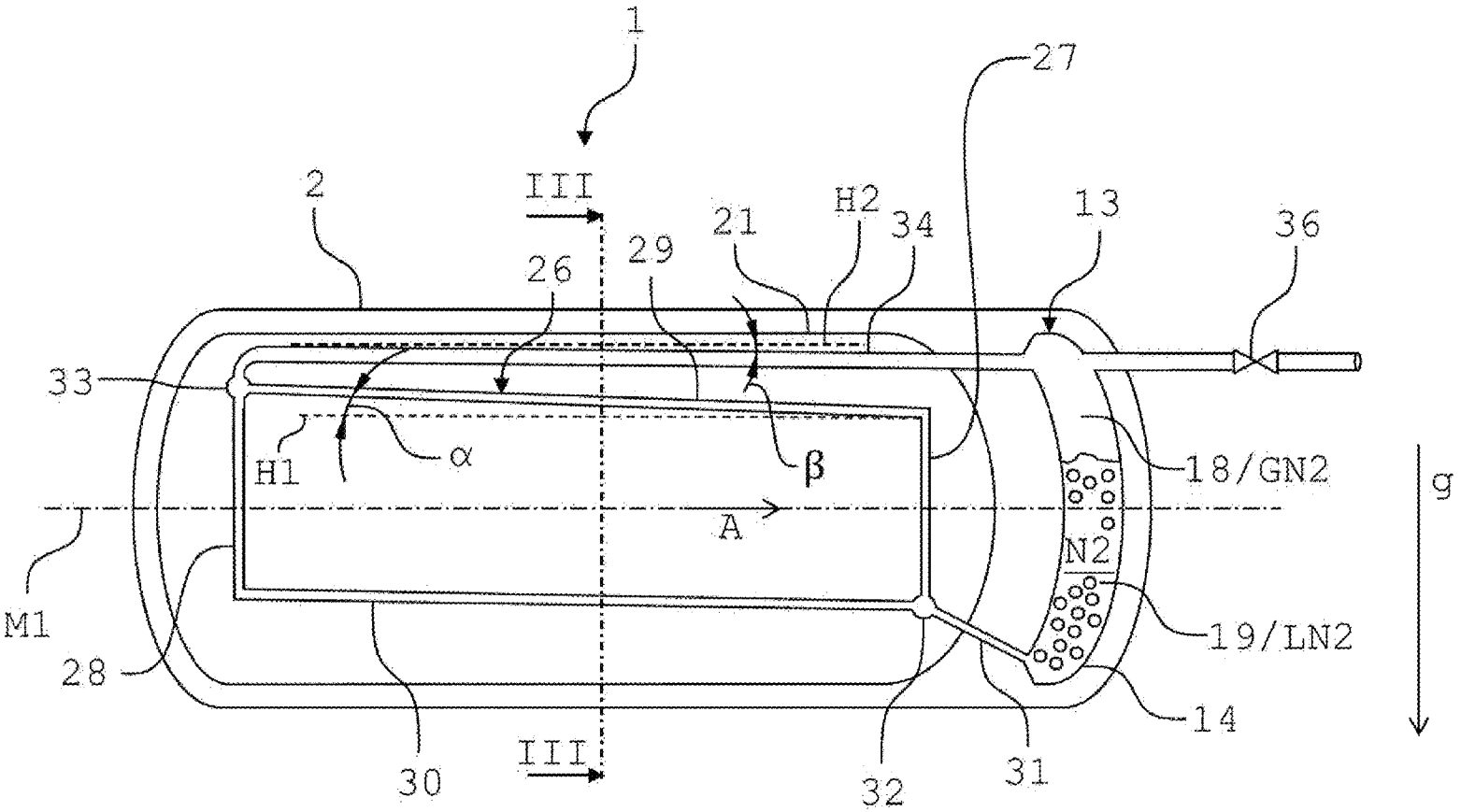
FIG. 2 shows a further schematic view of the transport container in FIG. 1.
Figure 3:
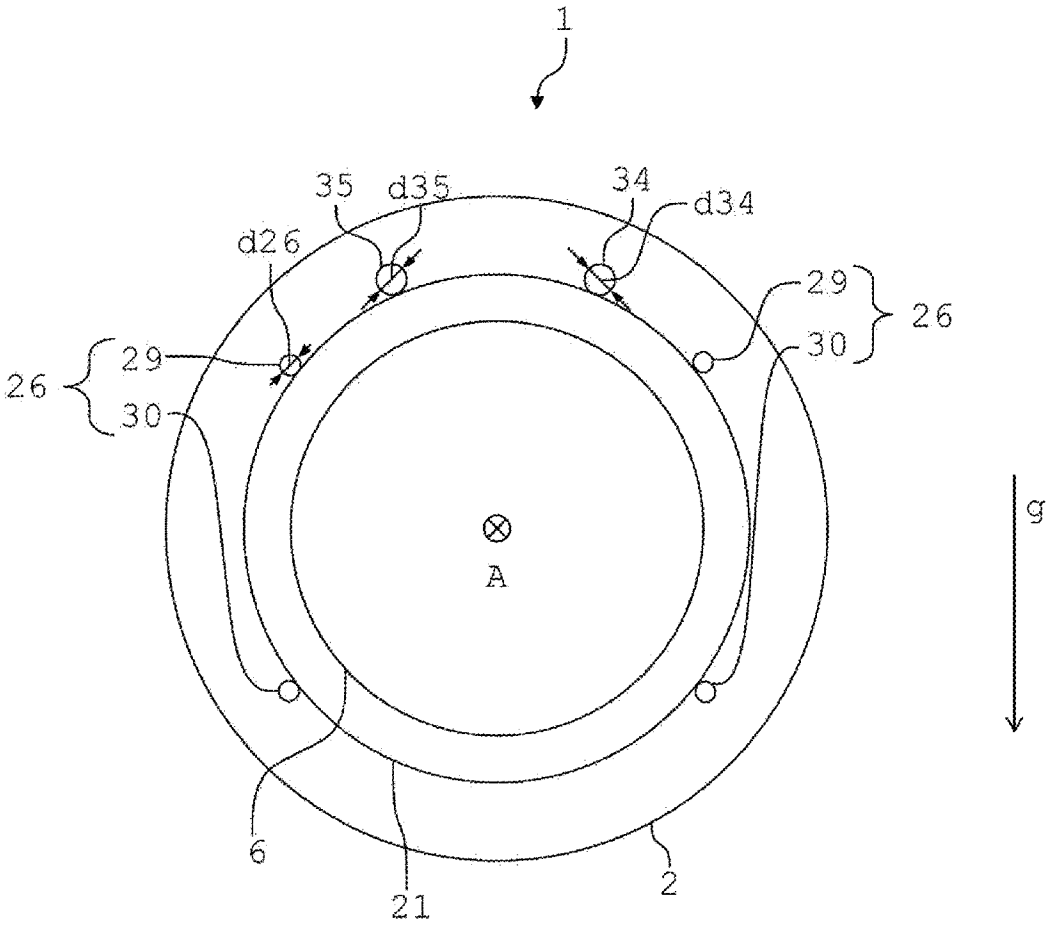
FIG. 3 shows a schematic sectional view of the transport container according to the section line III-III of FIG. 2.

In the figures, the same or functionally equivalent elements have been assigned the same reference symbols, unless indicated otherwise. FIG. 1 shows a highly simplified schematic view of an embodiment of a transport container 1 for liquid helium He. FIG. 2 shows a further, highly simplified schematic view of the transport container 1, and FIG. 3 shows a schematic sectional view of the transport container 1 along the section line III-III of FIG. 2. Hereafter, reference is made to FIGS. 1 through 3 at the same time.

The transport container 1 can also be referred to as a helium transport container. The transport container 1 can also be used for other cryogenic fluids. Examples of cryogenic fluids—or cryogens, for short—are the aforementioned liquid helium He (boiling point at 1 bara: 4.222 K=−268.929° C.), liquid hydrogen H2 (boiling point at 1 bara: 20.268 K=−252.882° C.), liquid nitrogen N2 (boiling point at 1 bara: 7.35 K=195.80° C.) or liquid oxygen O2 (boiling point at 1 bara: 9.18 K=182.97° C.).

The transport container 1 comprises an outer container 2. The outer container 2 can be made of stainless steel, for example. The outer container 2 can have a length L2 of 10 meters, for example. The outer container 2 comprises a tubular or cylindrical base section 3, which is closed at the end face on both sides with the aid of a cover section 4, 5—in particular, with the aid of a first cover section 4 and a second cover section 5. The base section 3 can have a circular or approximately circular geometry in cross-section. The cover sections 4, 5 are curved. The cover sections 4, 5 are curved in opposite directions, so that both cover sections 4, 5 are curved outwards with respect to the base section 3. The outer container 2 is fluid-tight, and, in particular, gas-tight. The outer container 2 has a central axis or an axis of symmetry M1, in relation to which the outer container 2 is designed to be rotationally symmetrical.

The transport container 1 further comprises an inner container 6 for receiving the helium He. The inner container 6 is not shown in FIG. 2. The inner container 6 is likewise made of stainless steel, for example. A gas zone 7 with vaporized helium He and a liquid zone 8 with liquid helium He can be provided in the inner container 6, as long as the helium He is in the two-phase region. The inner container 6 is fluid-tight, and, in particular, gas-tight, and can comprise a bleed valve for controlled pressure reduction. Like the outer container 2, the inner container 6 comprises a tubular or cylindrical base section 9, which is closed at the end face on both sides by cover sections 10, 11,—in particular, a first cover section 10 and a second cover section 11. The base section 9 can have a circular or approximately circular geometry in cross-section. Like the outer container 2, the inner container 6 is designed to be rotationally symmetrical with respect to the axis of symmetry M1. The inner container 6 is completely enclosed by the outer container 2. An evacuated gap or intermediate space 12 is provided between the outer container 2 and the inner container 6.

The transport container 1 further comprises a cooling system 13 (FIG. 2) with a coolant container 14. The intermediate space 12 is also provided between the coolant container 14 and the outer container 2. As mentioned above, the intermediate space 12 is evacuated. The intermediate space 12 completely envelops the inner container 6 and the coolant container 14.

A cryogenic fluid, such as nitrogen N2, is received in the coolant container 14. Hereafter, the cryogenic fluid is therefore referred to as nitrogen N2. The coolant container 14 comprises a tubular or cylindrical base section 15, which can be designed to be rotationally symmetrical with respect to the axis of symmetry M1. The base section 15 can have a circular or approximately circular geometry in cross-section. The base section 15 is closed at the end face by a cover section 16, 17 in each case, and, in particular, by a first cover section 16 and a second cover section 17. The cover sections 16, 17 can be curved. In particular, the cover sections 16, 17 are curved in the same direction. The coolant container 14 can also have a different design. The coolant container 14 is arranged outside the inner container 6, but inside the outer container 2.

A gas zone 18 with vaporized or gaseous nitrogen GN2 and a liquid zone 19 with liquid nitrogen LN2 can be provided in the coolant container 14. Viewed in a direction of gravity g, the gas zone 18 is arranged above the liquid zone 19. The gaseous nitrogen GN2 can also be referred to as the gaseous phase of the nitrogen N2 or of the cryogenic fluid. The liquid nitrogen LN2 can also be referred to as the liquid phase of the nitrogen N2 or of the cryogenic fluid. Viewed in an axial direction A of the transport container 1, the coolant container 14 is arranged next to the inner container 6. The axial direction A is positioned to be parallel to the axis of symmetry M1 or coincides therewith. The axial direction A from the first cover section 4 of the outer container 2 can be oriented in the direction of the second cover section 5 of the outer container 2. A gap or an intermediate space 20, which can be part of the intermediate space 12, is provided between the inner container 6—in particular, between the second cover section 11 of the inner container 6—and the coolant container 14—in particular, the first cover section 16 of the coolant container 14. This means that the intermediate space 20 is likewise evacuated.

The transport container 1 furthermore comprises a thermal shield 21 associated with the cooling system 13. The thermal shield 21 is arranged in the evacuated intermediate space 12 provided between the inner container 6 and the outer container 2. The thermal shield 21 is actively coolable or is actively cooled with the aid of the nitrogen N2. In the present case, active cooling is to be understood as meaning that the nitrogen N2 for cooling the thermal shield 21 is conducted through or guided along said thermal shield. Here, the thermal shield 21 is cooled to a temperature which approximately corresponds to the boiling point of the nitrogen N2.

The thermal shield 21 comprises a cylindrical or tubular base section 22, which is closed on both sides by a cover sections 23, 24,—in particular, a first cover section 23 and a second cover section 24—that close the base section at the end face. Both the base section 22 and the cover sections 23, 24 are actively cooled with the aid of the nitrogen N2. The base section 22 can have a circular or approximately circular geometry in cross-section. The thermal shield 21 is preferably likewise designed to be rotationally symmetrical with respect to the axis of symmetry M1.

Viewed in the axial direction A, the second cover section 24 of the thermal shield 21 is arranged between the inner container 6—in particular, the second cover section 11 of the inner container 6—and the coolant container 14—in particular, the first cover section 16 of the coolant container 14. The thermal shield 21—in particular, the second cover section 24 of the thermal shield 21—is a component separate from the coolant container 14. This means that the thermal shield 21—in particular, the second cover section 24 of the thermal shield 21—is not part of the coolant container 14. The intermediate space 12 completely envelops the thermal shield 21.

The first cover section 23 of the thermal shield 21 faces away from the coolant container 14. The first cover section 23 of the thermal shield 21 is arranged between the first cover section 4 of the outer container 2 and the first cover section 10 of the inner container 6. Thereby, the thermal shield 21 is self-supporting. This means that the thermal shield 21 is supported on neither the inner container 6 nor the outer container 2. For this purpose, a support ring can be provided on the thermal shield 21, which is suspended on the outer container 2 via supporting rods—in particular, tension rods. Furthermore, the inner container 6 can be suspended on the support ring via further supporting rods—in particular, tension rods. The heat transfer through the mechanical supporting rods is partially realized by the support ring. The support ring has pockets that allow a largest possible thermal length of the supporting rods. The coolant container 14 can include feedthroughs for the mechanical supporting rods.

The thermal shield 21 is fluid-permeable. This means that a gap or intermediate space 25 between the inner container 6 and the thermal shield 21 is fluidically connected to the intermediate space 12. The intermediate spaces 12, 25 can thus be evacuated at the same time. The intermediate space 25 completely envelops the inner container 6. An insulating element, which is not shown in FIGS. 1 through 3, can be arranged in the intermediate space 25. This insulating element can be or comprise a so-called MLI (multilayer insulation). Boreholes, apertures, or the like can be provided in the thermal shield 21 to allow the intermediate spaces 12, 25 to be evacuated simultaneously. The thermal shield 21 is preferably made of a high-purity aluminum material.

The second cover section 24 of the thermal shield 21 shields the coolant container 14 completely with respect to the inner container 6. This means that, when viewed from the inner container 6 towards the coolant container 14—in particular, when viewed in the axial direction A—the coolant container 14 is completely covered or shielded by the second cover section 24 of the thermal shield 21. In particular, the thermal shield 21 completely surrounds the inner container 6. This means that the inner container 6 is arranged completely within the thermal shield 21, wherein the thermal shield 21 is not fluid-tight, as already mentioned above.

As FIG. 2, in which the inner container 6 is not shown, further shows, the thermal shield 21 comprises at least one cooling line 26 for actively cooling the inner container. The cooling line 26 is associated with the cooling system 13. Preferably, several such cooling lines 26, e.g., six such cooling lines 26, are provided. However, the number of cooling lines 26 is arbitrary. The cooling line 26 can comprise two perpendicular sections 27, 28 extending in the direction of gravity g and two oblique sections 29, 30. The perpendicular sections 27, 28 can be provided on the cover sections 23, 24 and/or on the base section 22 of the thermal shield 21. The oblique sections 29, 30 can likewise be provided on the cover sections 23, 24 and/or on the base section 22. The section 27 is fluidically connected to the section 29, and the section 30 is fluidically connected to the section 28.

The cooling line 26 is connected to the thermal shield 21, both mechanically and thermally. For this purpose, the cooling line 26 can be integrally bonded to the thermal shield 21. In the case of integral bonds, the bonding partners are held together by atomic or molecular forces. Integral bonds are non-releasable connections that can be separated only by destroying the bonding means or the bonding partners. Integral bonding can be achieved, for example, by adhesive bonding, soldering, welding, or vulcanization. The cooling line 26 is, or the cooling lines 26 are, preferably welded, soldered, or adhesively bonded to the thermal shield 21.

The cooling line 26 is fluidically connected to the coolant container 14 with the aid of a connecting line 31 so that, when the coolant container 14 is filled, the nitrogen N2 is pushed from the coolant container 14 into the cooling line 26. The connecting line 31 is part of the cooling line 26. The cooling line 26 may also be directly in connection with the coolant container 14. The connecting line 31 opens into a distributor 32, from which the section 27 and the section 30 of the cooling line 26 branch off. The distributor 32 forms, with respect to the direction of gravity g, a lowest point of the cooling line 26. The distributor 32 can thus also be referred to as the lowest point of the cooling line 26. This lowest point of the cooling line 26 is fluidically connected to the liquid zone 19 of the coolant container 14 with the aid of the connecting line 31. In the process, the connecting line 31 can open into a lowest point, with respect to the direction of gravity g, of the coolant container 14. The section 29 and the section 28 of the cooling line 26 meet at a collector 33, which forms, with respect to the direction of gravity g, a highest point of the cooling line 26. The collector 33 can thus also be referred to as the highest point of the cooling line 26.

As previously mentioned, the cooling lines 26 are provided on both the base section 22 and the cover sections 23, 24 of the thermal shield 21. Alternatively, the cover sections 23, 24 are materially connected to the base section 22 in one piece—in particular, integrally. For example, the cover sections 23, 24 can be welded to the base section 22. Since the cover sections 23, 24 are materially connected to the base section 22 in one piece, i.e., integrally, the cover sections 23, 24 can also be cooled by heat conduction.

The cooling line 26, and, in particular, the oblique sections 29, 30 of the cooling line 26, have an incline with respect to a horizontal H1 which is arranged to be perpendicular to the direction of gravity g and parallel to the axis of symmetry M1. In particular, the oblique sections 29, 30 are inclined in the direction of the coolant container 14. The sections 29, 30 preferably have an angle of inclination $\alpha$ of more than 3° to the horizontal H. The angle of inclination $\alpha$ can be 3° to 15°, or even more. In particular, the angle of inclination $\alpha$ can also be exactly 3°. The angle of inclination $\alpha$ can also be referred to as the first inclination angle. In particular, the sections 29, 30 have a positive incline in the direction of the collector 33, so that gas bubbles arising in the cooling line 26 when the nitrogen N2 boils rise to the collector 33. A phase separator, which is arranged outside the outer container 2, and designed to separate the gaseous nitrogen GN2 from the liquid nitrogen LN2 and to bleed the gaseous nitrogen GN2 into the environment, can be connected to the collector 33. However, such a phase separator is dispensed with here.

An insulating element, which is not shown in FIGS. 1 through 3 and fills the intermediate space 12, can be arranged in the intermediate space 12. This insulating element is provided on the outer side of the thermal shield 21 and can fill the intermediate space 12. The insulating element preferably completely fills the intermediate space 12 in the region of the inner container 6, so that the insulating element makes contact there with the thermal shield 21 on the outside, and with the outer container 2 on the inside. The insulating element encloses the thermal shield 21, except for the second cover section 24 thereof, i.e., it encloses the first cover section 23 and the base section 22. Furthermore, the cylindrical base section 15 and the second cover section 17 of the coolant container 14 are enclosed by the insulating element. The insulating element is preferably likewise a so-called MLI, or can comprise an MLI. Like the thermal shield 21, the insulating element can be actively cooled. The active cooling takes place with the aid of the cryogenic gaseous nitrogen GN2. For the active cooling of the insulating element, a further cooling line can be led through it. The cooling line can be helical or spiral-shaped.

Furthermore, the transport container 1 comprises at least one return line 34, 35 (FIG. 3). Preferably, a first return line 34 and a second return line 35 are provided. However, the number of return lines 34, 35 is arbitrary. With the aid of the return lines 34, 35, the cooling line 26 is, or the cooling lines 26 are, fluidically connected to the coolant container 14, in order to return the nitrogen N2 to the coolant container 14 again after passage through the cooling line 26 or the cooling lines 26. The return lines 34, 35 can be provided on the outer side of the thermal shield 21. The return lines 34, 35 are at least mechanically connected to the thermal shield 21 and are preferably arranged between the thermal shield 21 and the outer container 2. Alternatively, the return lines 34, 35 can also be thermally connected to the thermal shield 21.

The return lines 34, 35 are inclined in the direction of the coolant container 14. In particular, the return lines 34, 35 are inclined at an angle of inclination $\beta$ relative to a horizontal H2. The horizontal H2 is arranged to be parallel to the horizontal H1 or coincides therewith. The angle of inclination $\beta$ can also be referred to as the second angle of inclination. The angle of inclination $\beta$ can be 4°, for example. The angle of inclination $\beta$ can be 4° to 15°, or even more. In particular, the angle of inclination $\beta$ can also be exactly 4°. The return lines 34, 35 are preferably associated with the cooling system 13.

Unlike the cooling line 26 or the cooling lines 26, which are fluidically connected to the liquid zone 19 of the coolant container 14, the return lines 34, 35 are fluidically connected to the gas zone 18 of the coolant container. This means that, with respect to the direction of gravity g, the cooling lines 34, 35 open into the coolant container 14 above the cooling line 26, and, in particular, above the connecting line 31 of the cooling line 26. The collector 33, which represents the highest point of the cooling line 26, is fluidically connected to the coolant container 14 with the aid of the return lines 34, 35. For this purpose, such a collector 33 can be provided on, for example, both sides of the thermal shield 21. The return lines 34, 35 preferably run parallel to one another. Here, an inside diameter d34, d35 of the return lines 34, 35 is larger than an inside diameter d26 of the cooling line 26. The inside diameter d26 of the cooling line 26 is preferably larger than 10 millimeters. The inside diameter d26 can be 12 millimeters, for example.

The cooling system 13 further comprises a bleed valve 36, with the aid of which the gaseous nitrogen GN2 can, depending upon the pressure, be bled off from the coolant container 14. The bleed valve 36 is suitable for bleeding off the gaseous nitrogen GN2 to the environment. Alternatively, the aforementioned, actively-cooled insulating element, which is arranged between the outer container 2 and the thermal shield 21, can be connected to the bleed valve 36. Bled off cryogenic gaseous nitrogen GN2 is then conducted through the insulating element to actively cool it. The gaseous nitrogen GN2 heated in the process can then be discharged into the environment after passing through the cooling line of the insulating element. Since the gaseous nitrogen GN2 is then no longer cryogenic, but heated, when exiting the insulating element, undesirable icing of the exit site can be prevented.

The operating principle of the transport container 1 will be explained below. Before filling the inner container 6 with helium He, the thermal shield 21 is first cooled at least approximately or completely to the boiling point (1.3 bara, 7.95 K) of the liquid nitrogen LN2 with the aid of cryogenic nitrogen N2, which initially is gaseous, and later liquid. The inner container 6 is not yet actively cooled. As the thermal shield 21 cools, the residual vacuum gas still present in the intermediate spaces 12, 20, 25 is frozen out at the thermal shield 21. As a result, when the inner container 6 is filled with the helium He, the residual vacuum gas can be prevented from freezing out on, and thus contaminating, the inner container 6. As soon as the thermal shield 21 and the coolant container 14 are completely cooled, and the coolant container 14 is completely filled with nitrogen N2 again, the inner container 6 is filled with the liquid helium He.

The transport container 1 can now be moved onto a transport vehicle, such as a truck or a ship, for transporting the helium He. In the process, the thermal shield 21 is continuously cooled with the aid of the liquid nitrogen LN2. The liquid nitrogen LN2 boils in the cooling line 26 or in the cooling lines 26. Gas bubbles formed in the process are supplied as gaseous nitrogen GN2 to the highest point of the cooling system 13, viz., the collector 33. It is always ensured, in the process, that the cooling line 26 is, or the cooling lines 26 are, supplied with liquid nitrogen LN2 across the entire length thereof, and thereby has or have a temperature corresponding approximately to the boiling point of the nitrogen N2.

The gas bubbles entrain liquid nitrogen LN2 from the cooling line 26 or from the cooling lines 26 and thus convey it into the return lines 34, 35. The liquid nitrogen LN2 is entrained by the resulting gas bubbles to a static height of approximately two meters. This results, not in continuous, but in discontinuous conveyance of the liquid nitrogen LN2. The liquid nitrogen LN2 is conveyed in a surge-like manner or by way of surges. The liquid nitrogen LN2 conveyed into the return lines 34, 35 and the gaseous nitrogen GN2 are returned to the coolant container 14 via the return lines 34, 35. The liquid nitrogen LN2 partially vaporizes in the return lines 34, 35. Non-vaporized fractions of the liquid nitrogen LN2 fall back into the coolant container 14. Since the return lines 34, 35 have a larger inside diameter d34, d35 than the cooling line 26, the entrained liquid nitrogen LN2 can be conveyed freely into the return lines 34, 35.

This results in a natural circulation of the nitrogen N2. This means that the nitrogen N2 is conveyed in a circuit by the cooling line 26, or the cooling lines 26, and the return lines 34, 35 without a pump that has movable parts.

The liquid nitrogen LN2 is conveyed only with the aid of the gaseous nitrogen GN2. The cooling line 26 or the cooling lines 26 and the return lines 34, 35 act as a so-called bubble pump or mammoth pump, which is suitable for conveying the liquid nitrogen LN2. This previously described, natural circulation functions without, or at least nearly without, overpressure. The pressure in the coolant container 14 can thus be lowered from the usually required 1.3 bara to 1.1 bara. This reduction of pressure in the coolant container 14 results in a decrease in the boiling temperature of the liquid nitrogen LN2 by 1.5 K. The heat transferred to the helium He is thereby reduced by approximately 5%, so that the helium holding time increases significantly, viz., by approximately three days, compared with an arrangement without such return lines 34, 35.

In the case of the transport container 1, it is, advantageously, possible to dispense with a phase separator for separating the liquid nitrogen LN2 from the gaseous nitrogen N2. Such a phase separator comprises moving components, which are subject to wear. This means that the phase separator has a limited service life. By dispensing with a phase separator, the costs both for producing and for maintaining such a transport container 1 are thus reduced. Furthermore, by dispensing with the phase separator, which is usually arranged on the outer side of the outer container 2 as an additional component, damage to the phase separator is also ruled out. Handling of the transport container 1 is thereby simplified. The heat transfer into the cooling system 13 caused by the phase separator is also not negligible. For this reason as well, dispensing with the phase separator is advantageous.

Because cryogenic gaseous nitrogen is discharged only at one location, viz., at the bleed valve 36, the active cooling of the insulating element arranged between the thermal shield 21 and the outer container 2 is easier to implement, since only one cooling line has to be run. If such an actively-cooled insulating element is provided, only heated gaseous nitrogen GN2 leaves the transport container 1, so that, in addition to the drastically increased holding time for the liquid nitrogen LIN2, no undesirable icing of the transport container 1 can occur, as already mentioned above.

Although the present invention has been described on the basis of exemplary embodiments, it can be modified in a variety of ways.

REFERENCE SYMBOLS USED

1 Transport container
2 Outer container
3 Base section
4 Cover section
5 Cover section
6 Inner container
7 Gas zone
8 Liquid zone
9 Base section
10 Cover section
11 Cover section
12 Intermediate space
13 Cooling system
14 Coolant container
15 Base section
16 Cover section
17 Cover section
18 Gas zone
19 Liquid zone
20 Intermediate space
21 Thermal shield
22 Base section
23 Cover section
24 Cover section
25 Intermediate space
26 Cooling line
27 Section
28 Section
29 Section
30 Section
31 Connecting line
32 Distributor
33 Collector
34 Return line
35 Return line
36 Bleed valve
A Axial direction
d26 Inside diameter
d34 Inside diameter
d35 Inside diameter
g Direction of gravity
GN2 Nitrogen
H1 Horizontal
H2 Horizontal He Helium
LN2 Nitrogen
L2 Length
M1 Axis of symmetry
N2 Nitrogen
α Angle of inclination
β Angle of inclination

The invention claimed is:

1. A transport container (1) for helium (He) comprising:
an inner container (6) for receiving the helium (He), a coolant container (14) for receiving a cryogenic fluid (N2), an outer container (2) in which the inner container (6) and the coolant container (14) are received, and a thermal shield (21) in which the inner container (6) is received and which can be actively cooled using the cryogenic fluid (N2),
said thermal shield (21) having at least one cooling line (26), which is fluidically connected to the coolant container (14) and in which the cryogenic fluid (N2) can be received in order to actively cool the thermal shield (21), and at least one return line (34, 35), by means of which the at least one cooling line (26) is fluidically connected to the coolant container (14) in order to return the cryogenic fluid (N2) back to the coolant container (14),
wherein an inside diameter (d34, d35) of the at least one return line (34, 35) is larger than an outside diameter (d26) of the at least one cooling line (26).

2. The transport container according to claim 1, wherein the at least one cooling line (26) is fluidically connected to a liquid zone (19) of the coolant container (14), and wherein the at least one return line (34, 35) is fluidically connected to a gas zone (18) of the coolant container (14).

3. The transport container according to claim 1, wherein the at least one return line (34, 35) opens into the coolant container (14) above, with respect to a direction of gravity (g), the at least one cooling line (26).

4. The transport container according to claim 1, wherein a lowest point of the at least one cooling line (26) is fluidically connected to the coolant container (14).

5. The transport container according to claim 1, wherein a highest point of the at least one cooling line (26) is fluidically connected to the coolant container (14) with the aid of the at least one return line (34, 35).

6. The transport container according to claim 1, wherein the inside diameter (d26) of the at least one cooling line (26) is larger than 10 millimeters.

7. The transport container according to claim 1, wherein the at least one return line (34, 35) is inclined in the direction of the coolant container (14) at an angle of inclination (β).

8. The transport container according to claim 1, wherein the at least one return line (34, 35) is connected to the thermal shield (21) and arranged between the thermal shield (21) and the outer container (2).

9. The transport container according to claim 1, wherein, during operation of the transport container (1), the cryogenic fluid (N2) boils to actively cool the thermal shield (21) in the at least one cooling line (26), so that gas bubbles, arising in the at least one cooling line (26), of a gaseous phase (GN2) of the cryogenic fluid (N2) convey a liquid phase (LN2) of the cryogenic fluid (N2) into the at least one return line (34, 35), so as to return the gaseous phase (GN2) of the cryogenic fluid (N2) and/or the liquid phase (LN2) of the cryogenic fluid (N2) back to the coolant container (14).

10. The transport container according to claim 1, wherein a first return line (34) and a second return line (35) are provided which run parallel to one another.

11. The transport container according to claim 1, wherein the coolant container (14) has a bleed valve (36) for bleeding off a gaseous phase (GN2) of the cryogenic fluid (N2) from the coolant container (14).

12. The transport container according to claim 1, wherein the inner container (6) is completely surrounded by the thermal shield (21).

13. The transport container according to claim 12, wherein the thermal shield (21) has a cover section (24) which is separate from the coolant container (14) and is arranged between the inner container (6) and the coolant container (14).

14. The transport container according to claim 1, wherein the coolant container (14) is arranged outside the thermal shield (21).

15. The transport container according to claim 1, wherein an intermediate space (12) is provided between the outer container (2) and the inner container (6) and between the outer container (2) and the coolant container (14).

16. The transport container according to claim 1, wherein the thermal shield (21) is fluid-permeable and a gap (25) is provided between the inner container (6) and the thermal shield (21), and said gap (25) is fluidically connected to the intermediate space (12).

17. The transport container according to claim 1, wherein the at least one cooling line (26) comprises two perpendicular sections (27, 28), extending in a direction of gravity (g), and two oblique sections (29, 30).

18. The transport container according to claim 1, wherein two oblique sections (29, 30) have an angle of inclination α of 3° to 15° relative to a horizontal.

19. The transport container according to claim 1, wherein the at least one return line (34, 35) is inclined at an angle of inclination β of 4° to 15° relative to a horizontal.

20. The transport container according to claim 10, wherein the first return line (34) and the second return line (35) are inclined at an angle of inclination β of 4° to 15° relative to a horizontal.

* * * * *